US006158734A

United States Patent [19]

Greive et al.

[11] Patent Number: 6,158,734

[45] Date of Patent: Dec. 12, 2000

[54] METHOD AND DEVICE FOR TRANSPORTING SHEETS BY AT LEAST ONE TRANSPORTING BELT, WHEREON THE SHEETS ARE FIXED ON A TRANSPORT PATH

[75] Inventors: Martin Greive, Schönau; Clemens Rensch, Heidelberg, both of Germany

[73] Assignee: Heidelberger Druckmaschinen Aktiengesellschaft, Heidelberg, Germany

[21] Appl. No.: 09/250,937

[22] Filed: Feb. 18, 1999

[30] Foreign Application Priority Data

Feb. 18, 1998 [DE] Germany ..... 198 06 633

[51] Int. Cl.[7] ..... B65H 5/02

[52] U.S. Cl. ..... 271/277; 271/198

[58] Field of Search ..... 271/275, 277, 271/198, 204, 205

[56] References Cited

U.S. PATENT DOCUMENTS 4,569,284 2/1986 Witczak ..... 271/277 X 5,121,170 6/1992 Bannai et al. ..... 271/275 X 5,413,327 5/1995 Reymond et al. ..... 271/275 X 5,443,254 8/1995 Reist ..... 271/275 X

*Primary Examiner*—David H. Bollinger

*Attorney, Agent, or Firm*—Herbert L. Lerner; Laurence A. Greenberg; Werner H. Stemer

[57] ABSTRACT

A method for transporting a sheet on a ferromagnetic transport belt which includes spacing a first switchable retaining device adjacent the ferromagnetic transport belt. The first switchable retaining device is used to position a magnetic retaining element, for example, a permanent magnet, on a sheet that is adjacent the transport belt. The magnet is released from the first switchable retaining device and is fixedly adhered to the transport belt. The sheet, which is caught between the magnet and the transport belt, is fixed to the transport belt and is transported to a second switchable retaining element that removes the magnet. The invention also encompasses a device including a first switchable retaining device that cooperates with the transport belt in the manner described.

14 Claims, 3 Drawing Sheets

METHOD AND DEVICE FOR TRANSPORTING SHEETS BY AT LEAST ONE TRANSPORTING BELT, WHEREON THE SHEETS ARE FIXED ON A TRANSPORT PATH

BACKGROUND OF THE INVENTION

Field of the Invention

The invention relates to a method and a device for transporting sheets transported by an endlessly revolving transporting or conveyor belt, whereon the sheets are at least partially fixed.

A device for fixing sheets on an endlessly revolving conveyor or transporting belt has become known heretofore, for example, from the published European Patent Document EP 0 099 054 B1.

In this regard, the transporting belt is magnetic and the sheets which are to be transported are magnetizable.

A disadvantage with regard to the transporting device according to the aforementioned European Patent Document EP 0 099 054 B1 is that the sheets which are to be transported have to contain magnetizable particles or layers in order to be able to fix them onto the magnetic transporting belt.

SUMMARY OF THE INVENTION

It is accordingly an object of the invention to provide a method and a device for transporting sheets which are able to be fixed onto a transporting belt without having to provide the sheets with a magnetizable additive.

With the foregoing and other objects in view, there is provided in accordance with one aspect of the invention, a method for transporting a sheet by a ferromagnetic transport belt, which comprises positioning, with a first switchable retaining device arranged at a spaced distance from the transport belt, a magnetic retaining element on the sheet to be transported, and transporting the sheet, that is fixed on the transport belt by the retaining element, past a second switchable retaining device that removes the retaining element from the sheet.

In accordance with another mode, the method of the invention includes positioning, with the second retaining device, the retaining element on the transport belt between two successive sheets, and removing, with the first retaining device, the retaining element from the transport belt.

In accordance with a further mode, the method of the invention includes removing, with the retaining device, the retaining element from the transport belt, and positioning the removed retaining element on the transport belt.

In accordance with another aspect of the invention, there is provided a device for transporting a sheet by at least one endlessly revolving transport belt, whereon the sheet is at least partially fixed, comprising a magnetically adhering retaining element for fixing the sheet onto the transport belt.

In accordance with an added feature of the invention, the retaining element is a permanent magnet. In accordance with an additional feature of the invention, the transporting device includes at least one switchable retaining device for the magnetic retaining element, the retaining device being arranged a slight spaced distance from the transport belt.

In accordance with yet another feature of the invention, the retaining device is an actuatable electromagnet with reversible polarity.

In accordance with an alternative feature, the retaining device is a pneumatically acting suction device.

In accordance with yet a further feature of the invention, the magnetically adhering retaining element is a flat annular disk.

In accordance with yet an added feature of the invention, the retaining device has a centering pin.

In accordance with yet an additional feature of the invention, the retaining device has a retaining surface for the magnetically adhering annular disk, the retaining surface surrounding the centering pin.

In accordance with still another feature of the invention, the transporting device includes a suction belt arranged in an end region of a transport path formed by the transport belt.

In accordance with still a further feature of the invention, the transporting device includes an ink jet printer arranged a short distance from the transport belt.

In accordance with a concomitant feature of the invention, the transporting device includes a sensor assigned to the at least one retaining device for sensing a sheet edge and the retaining element, respectively.

One advantage of the invention is that very flat retaining elements in the form of magnetic disks can be used. This measure makes it possible, for example, for a partially printed or non-printed sheet on the transport path formed by the transport belt to undergo single-color or multicolor printing, for example, by an ink jet printer.

In an advantageous configuration, retaining elements, arranged outside the transport belt, for the magnetic disks are provided at the start and end of the transport path. These retaining elements are constructed as actuatable electromagnets or retaining suckers.

A further development of the subject matter of the invention provides for a storage for magnetic disks which are not required to be arranged beneath the transport belt, i.e., in the region of the vacant return strand or slack side of the transport belt. This measure makes it possible to use the transport device for any desired sheet formats.

A further advantage is the contact-free release of the previously fixed sheet from the transport belt.

It is advantageously possible for constantly changing sheet formats to be transported without any additional mechanical format adaptation. In a further advantageous configuration, the disks are of annular form. This makes it possible for these disks to be placed in a precisely reproducible manner on the magnetic or pneumatic retaining element with the aid of a centering pin.

Other features which are considered as characteristic for the invention are set forth in the appended claims.

Although the invention is illustrated and described herein as embodied in a method and a device for transporting sheets by at least one transporting belt, whereon the sheets are fixed on a transport path, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
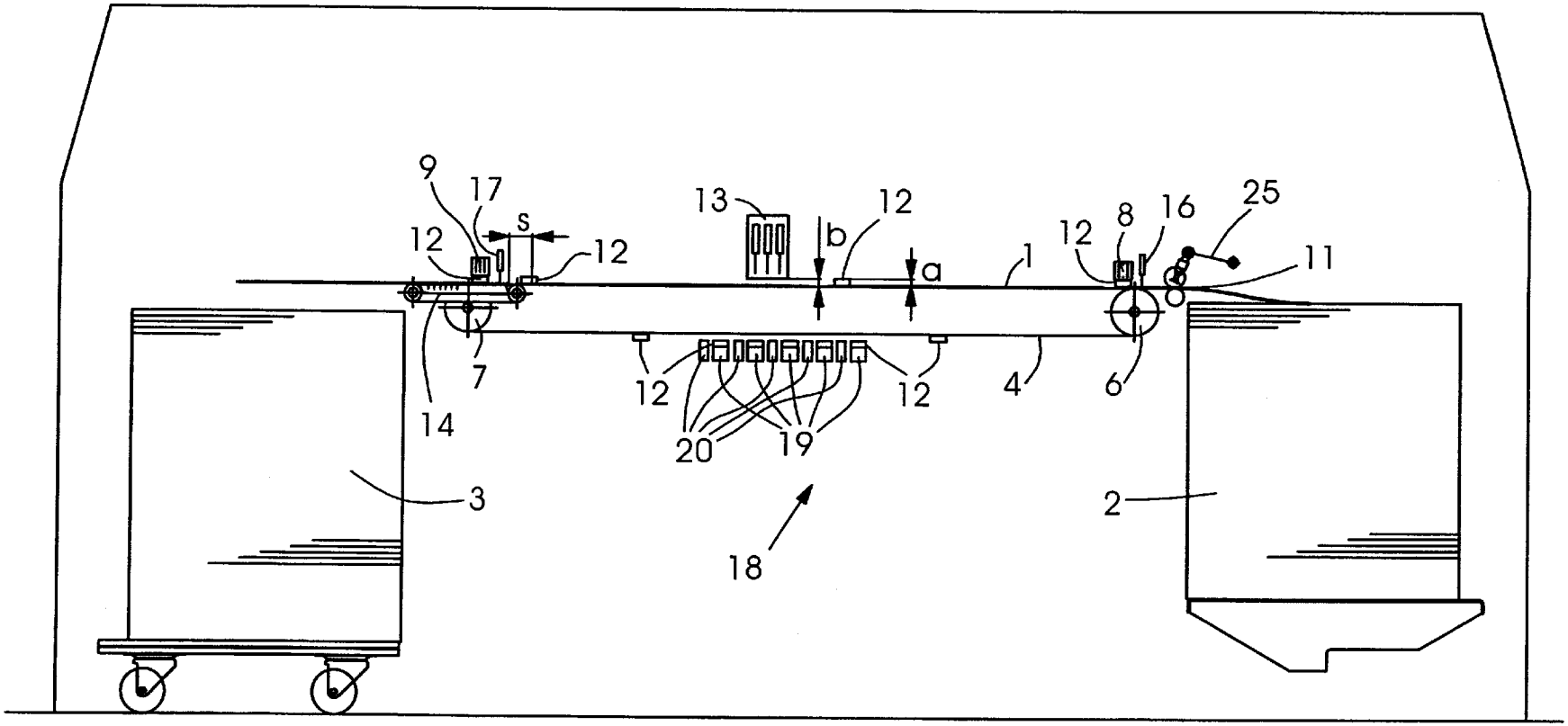
FIG. 1 is a diagrammatic side elevational view of a device according to the invention, for transporting sheets by at least one transporting or conveyor belt, whereon the sheets are fixed on a transport path.
Figure 2:
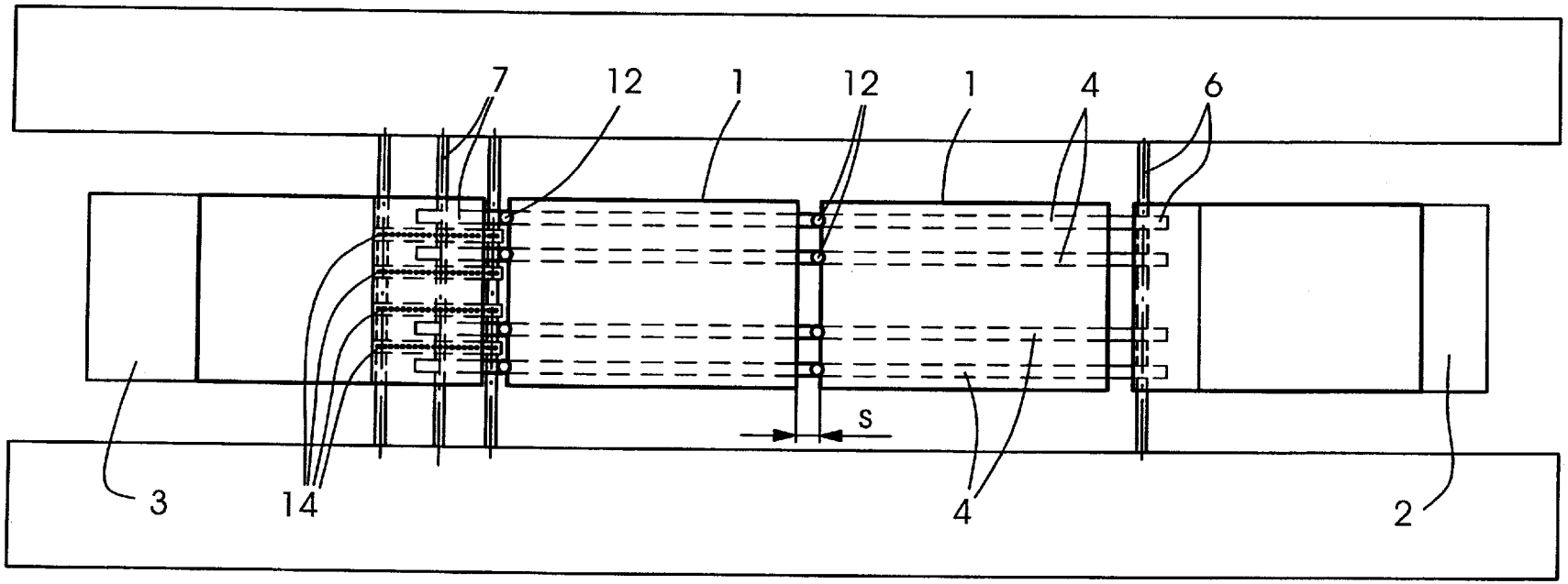
FIG. 2 is a diagrammatic top plan view of FIG. 1.

Referring now to the drawings and, first, particularly to FIGS. 1 and 2 thereof, there is shown therein a device for transporting sheets 1 from a sheet pile 2 to a sheet pile 3, the transporting device having at least one flexible, ferromagnetic transport or conveyor belt 4, which is formed, for example, as a thin steel band or belt.

The transport belt 4 is an endlessly revolving transport belt which is looped around at least two deflection rollers 6 and 7, of which at least one is driven.

A switchable, actuatable first retaining device or holder 8 is arranged in a region of the transport belt 4 that is directed towards a first sheet pile 2, that corresponds to the start of a transporting path defined by the transport belt 4. A second switchable, actuatable retaining device or holder 9 is located at the end of the transport path, in a region of the transport belt 4 that is directed towards the sheet pile 3. The retaining devices 8 and 9 are preferably constructed as switchable electromagnets. It is alternatively proposed to construct the retaining devices or holders 8 and 9 as pneumatically acting devices, e.g., as switchable lifting suckers.

A separating device 25 lifts the sheet 1 from the sheet pile 2 and feeds it to the transport belt 4 by timed rollers 11. The sheet 1 is fixed on the transport belt 4 by magnetic retaining elements 12, e.g., permanent magnets made of NdFeB (neodymium-iron-boron). The permanent magnets 12 are retained by the retaining device 8 initially closely above the transport belt 4. The instant the leading edge of the sheet 1 passes the retaining device 8, the permanent magnet 12 is released from the retaining device 8 and thus deposited on the front region of the sheet 1. The force field produced by the permanent magnet 12 acts through the sheet 1, with the result that the sheet 1 is secured by the permanent magnet together with the ferromagnetic transport belt 4.

A sheet 1 fixed in this way may thus undergo, for example, on the transport path thereof, single-color printing or multicolor printing by an ink jet printer 13.

The retaining elements 12 are preferably constructed as annular disks or washers having a small thickness a (a=approximately 0.5 mm). By this measure, the ink jet printer 13 can be arranged a short distance b (b>a+sheet thickness d) from the transport belt 4.

Once the sheet 1 passes into the end region of the transport path and passes the retaining device 9 thereat, the latter is then activated so that the annular permanent magnet 12 is removed from the sheet 1 and the transport belt 4.

In order to retain the sheet 1, which then rests freely on the transport belt 4, a suction belt 14, for example, is provided, which receives the sheet 1 and conveys it onto the sheet pile 3.

Once the end of the sheet 1 has passed the retaining device 9, the latter releases the permanent magnet 12 and deposits it on the transport belt 4 between the trailing edge of the preceding sheet 1 and the leading edge of the following sheet 1.

Activation of the retaining devices 8 and 9 takes place in time or in operating synchronism with the transport device, depending upon the sheet format which is to be processed.

For the purpose of selectively activating and deactivating the retaining devices 8 and 9, respective sensors 16 and 17, which respond to the presence of the sheet leading edge or to the permanent magnets 12, may be provided in order to deposit the latter on the transport belt 4 or the sheet 1 and to pick them up, respectively.

The invention is described herein with reference to a single transport belt 4, but it is also possible, of course, for two or more transport belts to be used adjacent and parallel to one another. In this regard, use is also made of a corresponding number of retaining devices 8 and 9 disposed adjacent and parallel to one another, as clearly shown in FIG. 2.

For processing different sheet formats, it may be necessary to use a relatively large number of permanent magnets 12 in order to achieve a constant spacing s between two successive sheets 1.

A further structural feature of the device according to the invention is a storage device 18 provided for excess permanent magnets 12, the storage device 18 being arranged on a vacant or idle strand, i.e., on the slack side of the transport belt 4.

In this regard, a number of switchable retaining devices 19 are arranged, in the direction of movement of the transport belt 4, beneath the vacant strand or slack side of the transport belt 4. Each retaining device 19 may have a sensor 20 assigned thereto for sensing the respective retaining element 12.

If required, e.g., for processing small sheet formats, the permanent magnets 12 are released from the retaining devices 19, and attached to the transport belt 4, at the appropriate format spacing. Just like the retaining devices 8 and 9, the retaining devices 19 operate magnetically or pneumatically in this regard.

Figure 3:
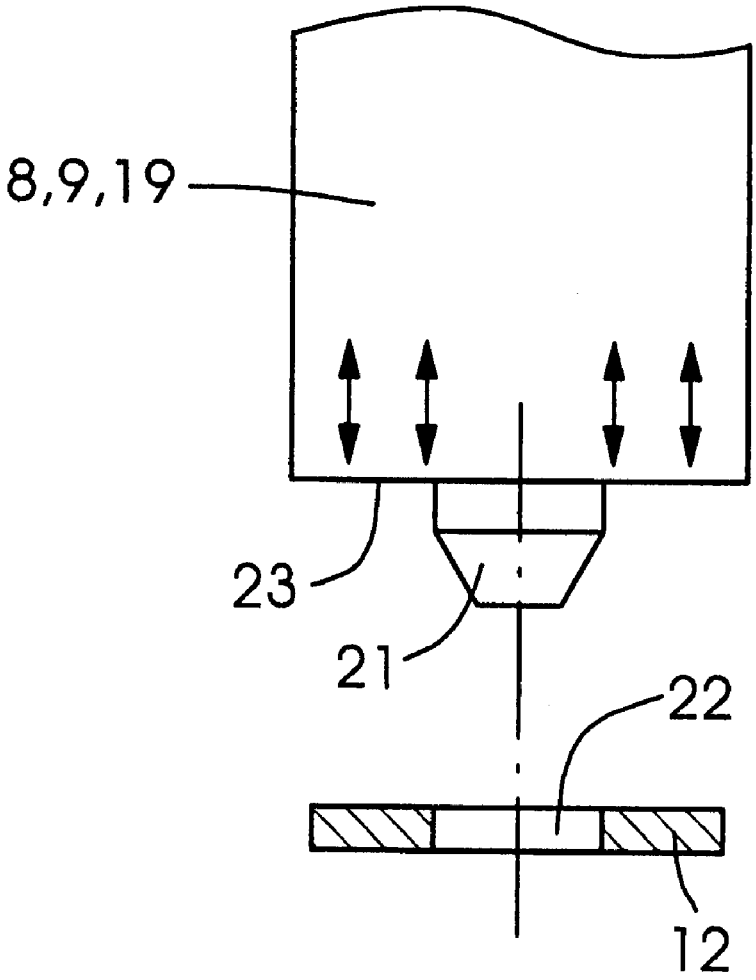
FIG. 3 is a much-enlarged fragmentary view of FIG. 1 showing an actuatable retainer forming part of the device according to the invention.

On the side thereof that is directed towards the transport belt, the retaining devices 8, 9 and 19, have a centering pin 21, as shown in FIG. 3, that engages in a central hole 22 formed in the annular permanent magnet 12. An annular surface 23 around the centering pin 21 of the retaining device 8, 9 and 19 is formed magnetically or pneumatically.

We claim:

1. A method for transporting a sheet with a ferromagnetic transport belt, which comprises:

spacing a first switchable retaining device at a predetermined distance away from a ferromagnetic transport belt;

retaining at least one magnetic retaining element with the first switchable retaining device;

using the first switchable retaining device to position the magnetic retaining element on a sheet that is adjacent the transport belt and to fix the sheet to the transport belt;

transporting the sheet with the transport belt to a second switchable retaining device; and using the second switchable retaining element to remove the magnetic retaining element from the sheet.

2. The method according to claim 1, which comprises:

using, the second switchable retaining device to position the magnetic retaining element on the transport belt between two successive sheets; and using the first switchable retaining device to remove the magnetic retaining element from the transport belt.

3. The method according to claim 1, which comprises:

using the second switchable retaining device to position the magnetic retaining element on the transport belt between two successive sheets; and using a third switchable retaining device to remove the magnetic retaining element from the transport belt and to subsequently position the magnetic retaining element on the transport belt.

4. A device for transporting a sheet comprising:

a sheet transporting device including at least two rollers and at least one ferromagnetic transport belt looped around said rollers, at least one of said rollers connectable to a drive for driving the ferromagnetic transport belt;

at least one magnetically adhering retaining element for fixing a sheet to said ferromagnetic transport belt; and at least one switchable retaining device for positioning the magnetically adhering retaining element onto a sheet to be fixed to said ferromagnetic transport belt, said switchable retaining device configured at a spaced distance away from said transport belt.

5. The transporting device according to claim 4, wherein said retaining element is a permanent magnet.

6. The transporting device according to claim 4, wherein said retaining device is an actuatable electromagnet with reversible polarity.

7. The transporting device according to claim 4, wherein said retaining device is a pneumatically acting suction device.

8. The transporting device according to claim 4, wherein said magnetically adhering retaining element is a flat annular disk.

9. The transporting device according to claim 8, wherein said retaining device has a centering pin.

10. The transporting device according to claim 9, wherein said retaining device has a retaining surface for the magnetically adhering annular disk, said retaining surface surrounding said centering pin.

11. The transporting device according to claim 4, including a suction belt arranged in an end region of a transport path formed by said transport belt.

12. The transporting device according to claim 4, including an ink jet printer arranged a short distance from said transport belt.

13. The transporting device according to claim 4, including a sensor assigned to said at least one retaining device for sensing a sheet edge and said retaining element, respectively.

14. A device for transporting a sheet, comprising:

a sheet transporting device including at least two rollers and at least one ferromagnetic transport belt looped around said rollers, at least one of said rollers connectable to a drive for driving the ferromagnetic transport belt; and at least one switchable retaining device for positioning a magnetically adhering retaining element onto a sheet to fix the sheet to said ferromagnetic transport belt, said switchable retaining device configured at a spaced distance away from said transport belt.

* * * * *